US011219990B2

(12) United States Patent
Tsai

(10) Patent No.: US 11,219,990 B2
(45) Date of Patent: Jan. 11, 2022

(54) TOOL FOR DETACHING PARTS FROM VEHICLES

(71) Applicant: Chien Yu Hong Co., Ltd., Taichung (TW)

(72) Inventor: Chang-Ta Tsai, Taichung (TW)

(73) Assignee: Chien Yu Hong Co., Ltd., Taichung (TW)

( * ) Notice: Subject to any disclaimer, the term of this patent is extended or adjusted under 35 U.S.C. 154(b) by 255 days.

(21) Appl. No.: 16/693,550

(22) Filed: Nov. 25, 2019

(65) Prior Publication Data

US 2021/0154814 A1 May 27, 2021

(51) Int. Cl.
*B25B 27/00* (2006.01)
*B25D 1/16* (2006.01)
*B25B 27/06* (2006.01)

(52) U.S. Cl.
CPC ..... *B25B 27/0035* (2013.01); *B25B 27/062* (2013.01); *B25D 1/16* (2013.01)

(58) Field of Classification Search
CPC ..... B25B 27/0035
USPC ..... 29/256
See application file for complete search history.

(56) References Cited

FOREIGN PATENT DOCUMENTS

TW M-579079 U * 6/2019

OTHER PUBLICATIONS

Astro Tool Model 78410 Amazon.com. 2018. [online] Available at: <https://www.amazon.com/Astro-Pneumatic-Tool-78410-Adjustable/dp/B01JBNZSZI/> [Accessed Sep. 27, 2021], (Year: 2018).*

* cited by examiner

*Primary Examiner* — Lee D Wilson
*Assistant Examiner* — Jonathan G Santiago Martinez
(74) *Attorney, Agent, or Firm* — Alan D. Kamrath; Karin L. Williams; Mayer & Williams PC

(57) ABSTRACT

A tool includes an operative rod, a guiding rod, a conveying screw and two detaching elements. The guiding rod includes a middle section connected to the operative rod and two terminal sections extending from the middle section. The conveying screw includes two threaded sections. Threads of the threaded sections extend in opposite directions. Each of the detaching elements includes a fixing aperture and a screw hole. The fixing aperture receives a corresponding one of the terminal sections of the guiding rod. The screw hole receives a corresponding one of the threaded sections of the conveying screw. Thus, the detaching elements are moved toward each other when the conveying screw is rotated in a first direction and that the detaching elements are moved from each other when the conveying screw is rotated in a second direction.

10 Claims, 11 Drawing Sheets

TOOL FOR DETACHING PARTS FROM VEHICLES

BACKGROUND OF INVENTION

1. Field of Invention

The present invention relates to vehicles and, more particularly, to a tool for detaching parts from vehicles.

2. Related Prior Art

Specific tools are used to detach various parts from vehicles in repairing the vehicles. Such a tool typically includes a detaching module connected to an operative rod. The operative rod is operable to push or pull the detaching module to detach a part from a vehicle. Such parts are made of various sizes. Hence, the detaching module must be adjustable to deal with parts made of various sizes. However, such adjustable detaching modules are often unsteady.

The present invention is therefore intended to obviate or at least alleviate the problems encountered in prior art.

SUMMARY OF INVENTION

It is the primary objective of the present invention to provide a reliable tool for detaching parts of various sizes from vehicles.

To achieve the foregoing objective, the tool includes an operative rod, a guiding rod, a conveying screw, two detaching elements and a positioning element. The guiding rod includes a middle section connected to the operative rod and two terminal sections extending from the middle section. The conveying screw includes two threaded sections and two annular flanges formed between the threaded sections. Threads of the threaded sections extend in opposite directions. Each of the detaching elements includes a fixing aperture and a screw hole. The fixing aperture receives a corresponding one of the tell final sections of the guiding rod. The screw hole receives a corresponding one of the threaded sections of the conveying screw. Thus, the detaching elements are moved toward each other when the conveying screw is rotated in a first direction and that the detaching elements are moved from each other when the conveying screw is rotated in a second direction. The positioning element includes a section inserted in the operative rod and a tip confined between the annular flanges.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF EMBODIMENTS

Figure 1:
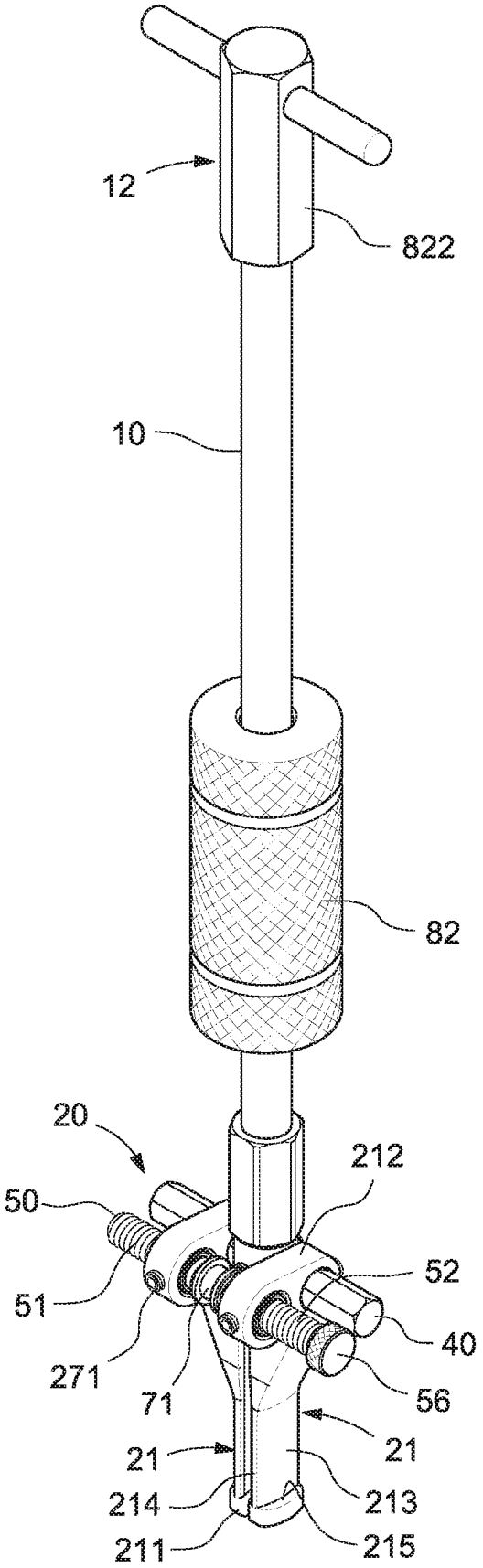
FIG. 1 is a perspective view of a tool according to the first embodiment of the present invention.
Figure 2:
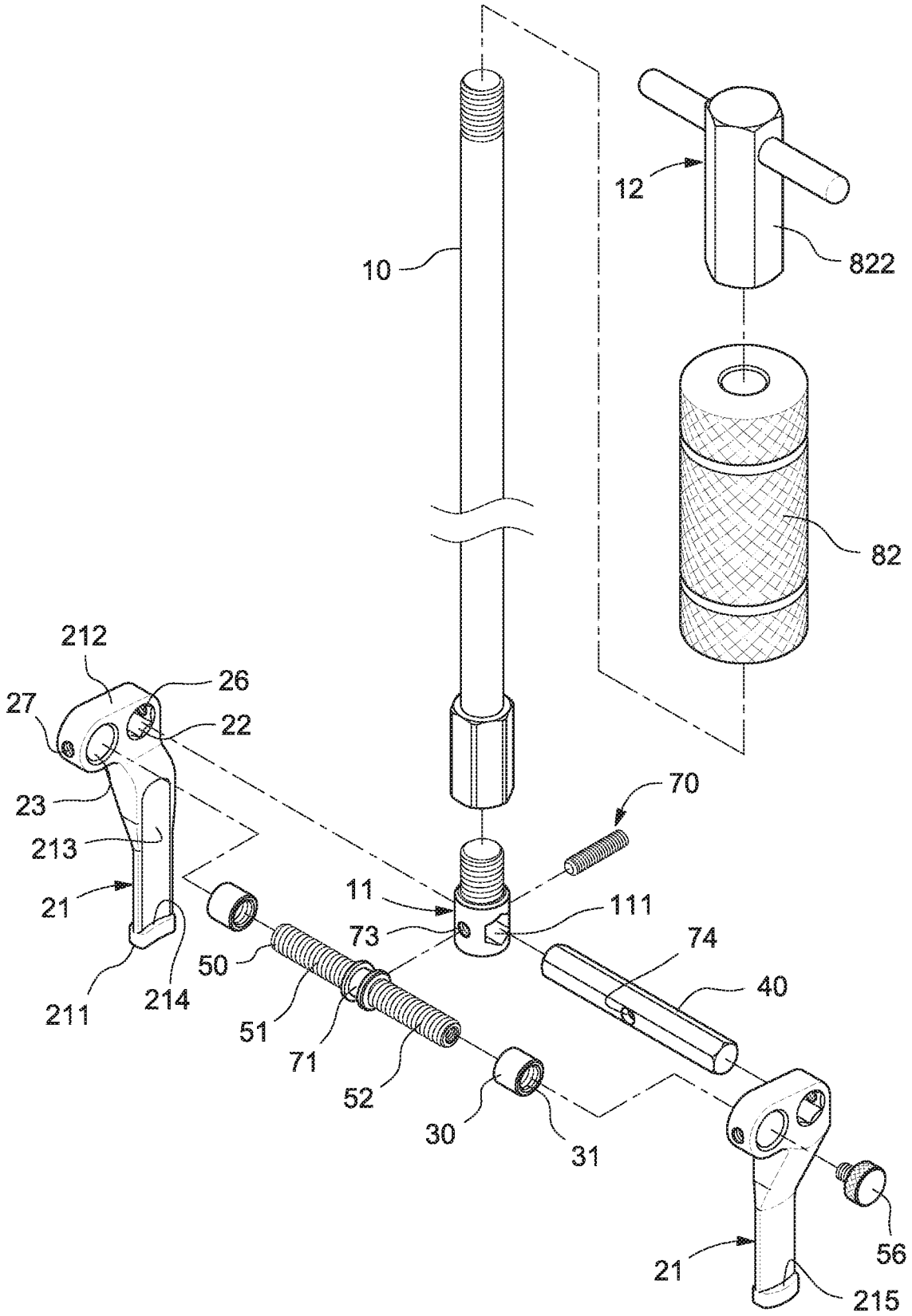
FIG. 2 is an exploded view of the tool shown in FIG. 1.
Figure 3:
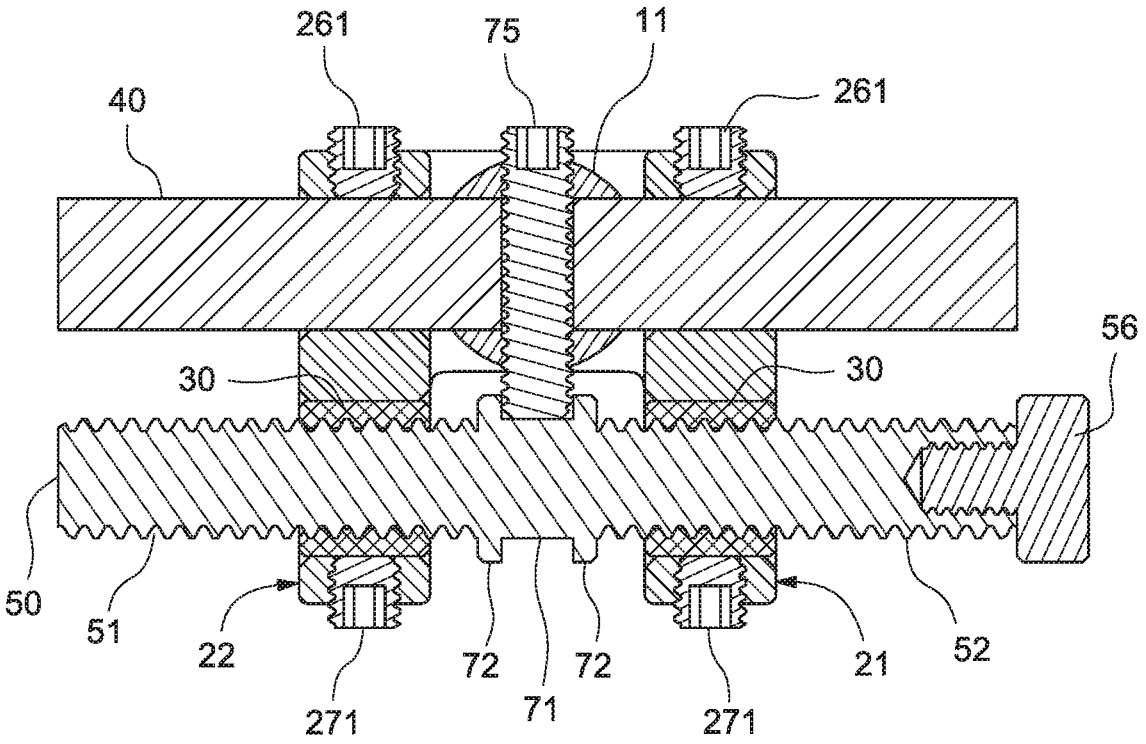
FIG. 3 is a cross-sectional view of the too shown in FIG. 1.

Referring to FIGS. 1 through 4, a tool includes an operative rod 10, a detaching module 20, two adjusting rings 30, a guiding rod 40, a conveying screw 50, a positioning assembly 70 and a sliding hammer 80 according to a first embodiment of the present invention. A front end element 11 is connected to a front end of the operative rod 10. A rear end element 12 includes an anvil 822 connected to a rear end of the operative rod 10 and a handle bar (not numbered) connected to the anvil 822.

The sliding hammer 80 is a tubular element. The sliding hammer 80 is movably located on the operative rod 10 before the first and second end elements 11 and 12 are connected to the front and rear ends of the operative rod 10.

The operative rod 10 and the front and rear end elements 11 and 12 are not made in one piece in the first embodiment that includes the sliding hammer 80. The operative rod 10 and the front and rear end elements 11 and 12 can be made in one piece in another embodiment that does not include the sliding hammer 80.

In use, the detaching module 20 is engaged with a part to be detached from a vehicle. The detaching module 20 can be made of various shapes corresponding to the parts.

The detaching module 20 includes two detaching elements 21. Each of the detaching elements 21 includes a front end 211 and a rear end 212. The rear end 212 includes a fixing aperture 22 and an adjusting aperture 23. The rear end 212 further includes a screw hole 26 in communication with the fixing aperture 22. The screw hole 26 receives a screw 261. The rear end 212 further includes a screw hole 27 in communication with the adjusting aperture 23. The screw hole 27 receives a screw 271.

The adjusting rings 30 are inserted in the screw holes 23 of the detaching elements 21. Each of the adjusting rings 30 includes a screw hole 31. Threads formed on walls of the screw holes 31 of the adjusting rings 30 extend in opposite directions. Two screws 271 are inserted in the screw holes 27 of the detaching elements 21 so that a tip of each of the screws 271 abuts against and hence keeps a corresponding one of the adjusting rings 30 in the adjusting aperture 23 of a corresponding one of the detaching elements 21.

The guiding rod 40 is a polygonal rod including a middle section formed between two terminal sections. The middle section of the guiding rod 40 is inserted in a polygonal aperture 111 made in the front end element 11. The terminal sections of the guiding rod 40 are inserted in the fixing apertures 22 of the detaching elements 21. Two screws 261 are rotatable in the screw holes 26 of the detaching elements 21 in a direction so that a tip of each of the screws 261 abuts against a corresponding one of the terminal sections of the guiding rod 40 and hence keeps a corresponding one of the detaching elements 21 in position relative to the guiding rod 40. The screws 261 are rotatable in the screw holes 26 of the detaching elements 21 in an opposite direction so that the tip of each screw 261 leaves the corresponding terminal section of the guiding rod 40 and hence allows the corresponding detaching elements 21 to slide relative to the guiding rod 40.

The conveying screw 50 includes two threaded sections 51 and 52 respectively inserted in the screw holes 31 of the adjusting rings 30, which are respectively inserted in the detaching elements 21. Threads of the threaded sections 51 and 52 extend in opposite directions. The conveying screw 50 includes a screw hole (not numbered) in an end. The screw hole of the conveying screw 50 receives a threaded section (not numbered) of a knob 56, thereby connecting the knob 56 to the conveying screw 50. In addition, adhesive is used to keep the knob 56 on the conveying screw 50 and prevent the knob 56 from rotation relative to the conveying screw 50. Thus, it is ensured that the knob 56 is operable to rotate the conveying screw 50.

The positioning assembly 70 includes two annular flanges 72 formed on the conveying screw 50 between the threaded sections 51 and 52, a smooth section 71 formed between the annular flanges 72, an aperture 73 made in the front end element 11, an aperture 74 made in the guiding rod 40, and a positioning element 75. The conveying screw 50 and the smooth section 71 and the annular flanges 72 are made in one piece. The apertures 73 and 74 are screw holes. The conveying screw 50 and the positioning element 75 are not made in one piece. The positioning element 75 is a threaded rod inserted in the apertures 73 and 74 so that the positioning element 75 is translated relative to the front end element 11 and the guiding element 40 when the positioning element 75 is rotated in the apertures 73 and 74. A front end of the positioning element 75 is in contact with the smooth section 71 between the annular flanges 72.

Figure 4:
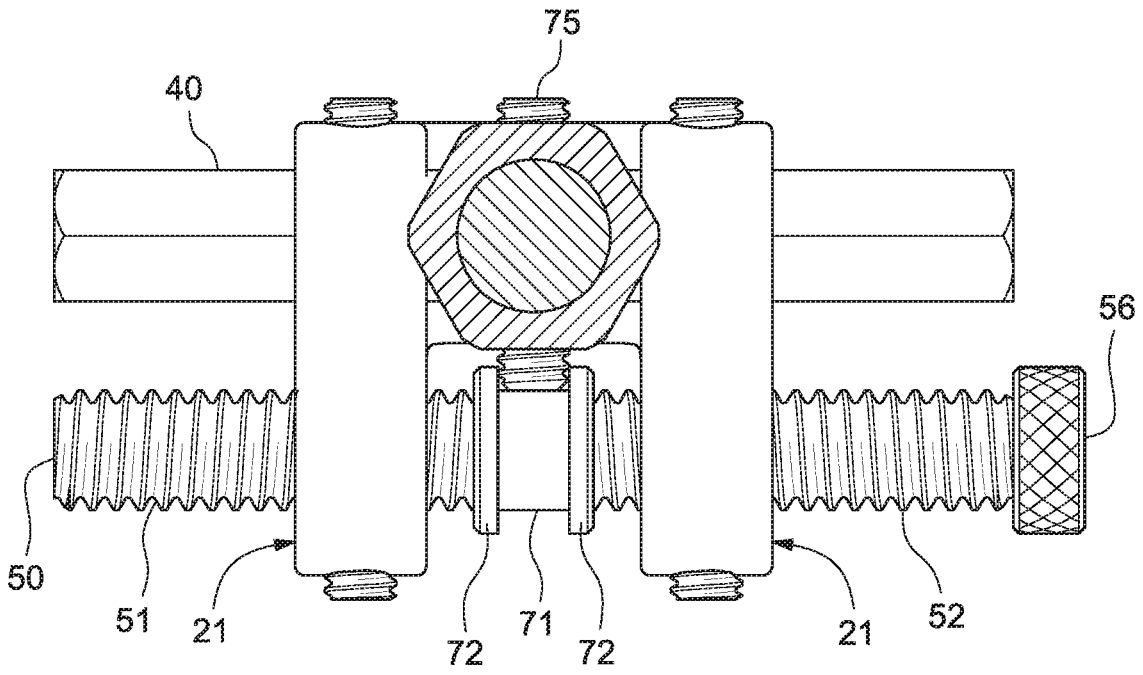
FIG. 4 is another cross-sectional view of the too shown in FIG. 3.
Figure 5:
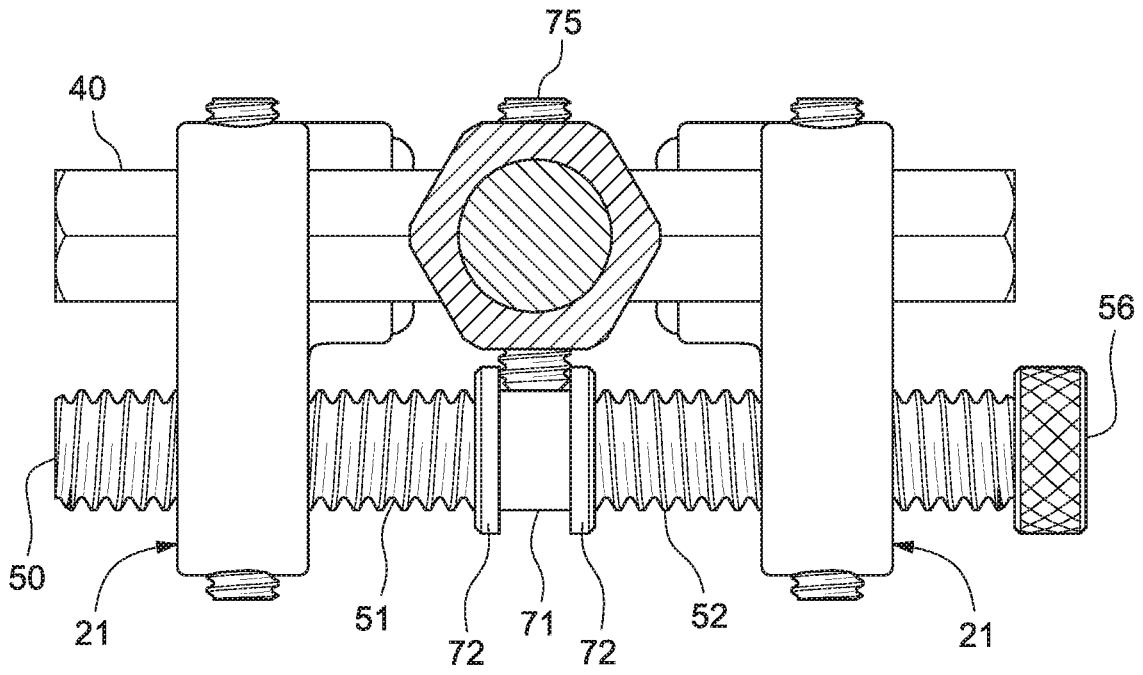
FIG. 5 is a cross-sectional view of the tool in another position other than shown in FIG. 4.
Figure 6:
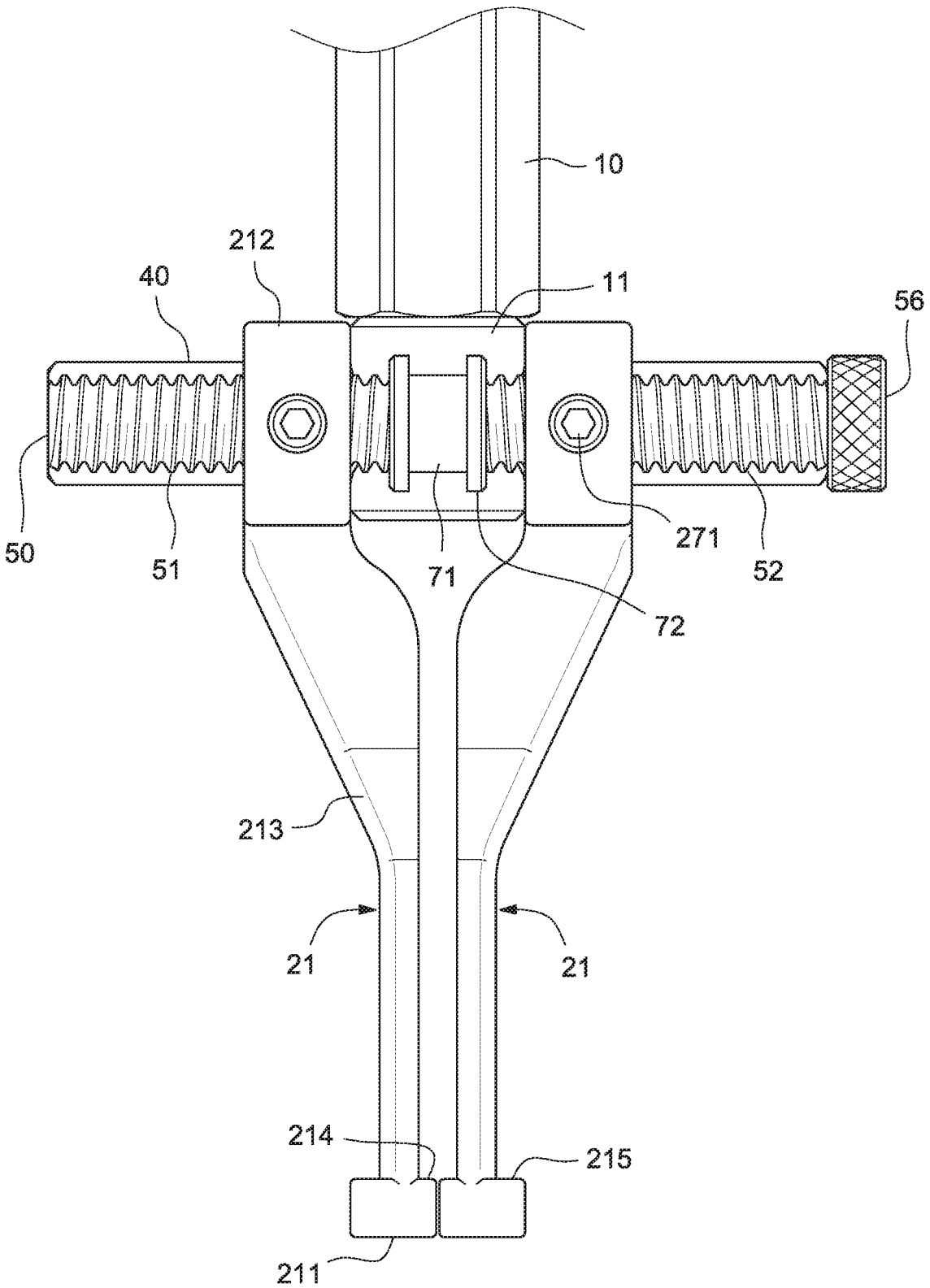
FIG. 6 is a top view of the tool shown in FIG. 1.
Figure 7:
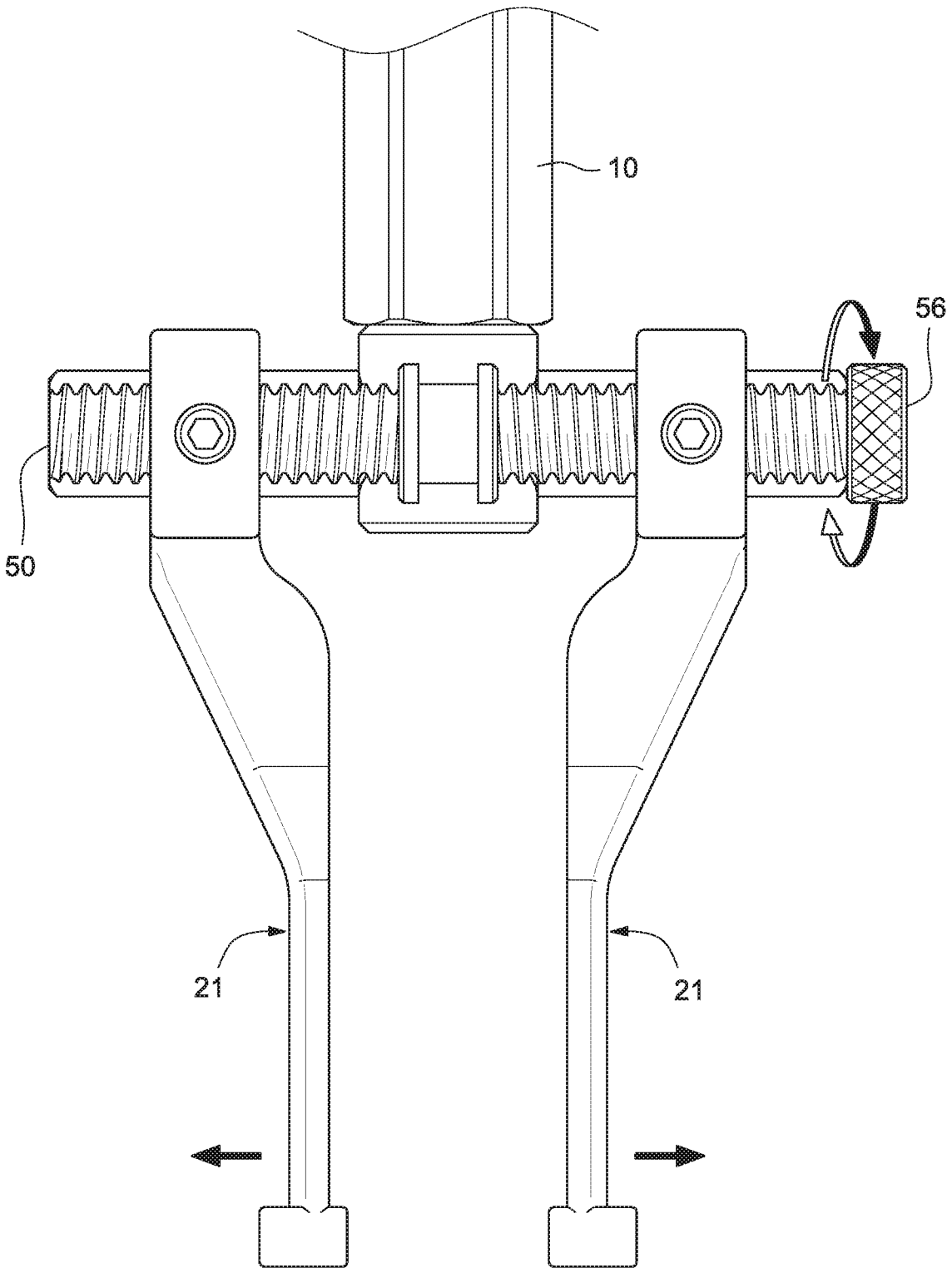
FIG. 7 is a top view of the tool in another position other than shown in FIG. 6.
Figure 8:
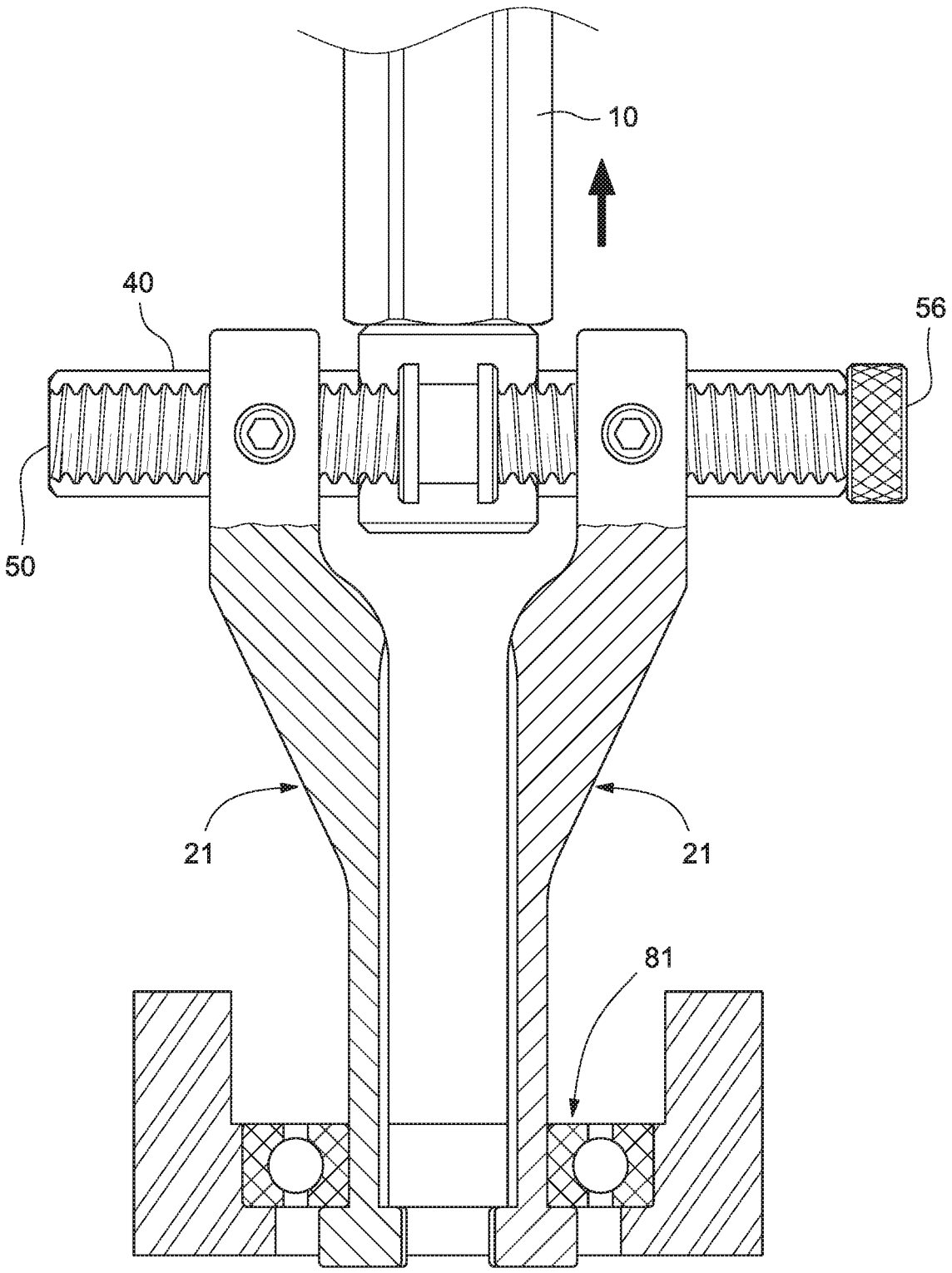
FIG. 8 is another cross-sectional view of the too shown in FIG. 4.

Referring to FIGS. 4 and 5, the positioning assembly 70 aligns a middle point of the conveying screw 50 to the front end element 11 of the operative rod 10, thereby locating the detaching elements 21 at a same distance from the front end element 11.

The screws 261 are rotatable in an unlocking direction to move their tips from the guiding element 40 to allow the detaching elements 21 to move on the guiding element 40. The knob 56 is operable to rotate the conveying screw 50 to translate the detaching elements 21. The positioning assembly 70 prevents the conveying screw 50 from translation. Thus, the detaching elements 21 are ensured to move toward or from each other for a same distance along the threaded sections 51 and 52.

The screws 261 are rotatable in a locking direction to abut their tips against the guiding element 40 to keep the detaching elements 21 in position on the guiding element 40. Now, the detaching module 20 can be used to detach parts from vehicles.

Alternately, only one of the screws 261 and only one of the screws 271 are rotated in the unlocking direction to allow only one of the detaching elements 21 to translate mildly along the guiding rod 40 and the conveying screw 50, which is inserted in the adjusting ring 30. Thus, the detaching elements 21 are ensured to be at a same distance from the middle point of the conveying screw 50 even when there is an error between the threaded sections 51 and 52. Then, the screw 261 and the corresponding screw 271 are rotated in the locking direction again to keep the detaching elements 21 in position relative to the guiding rod 40 and the corresponding adjusting ring 30.

Referring to FIGS. 1, 2 and 6 to 8, a to-be-detached part is a bearing 80 to be detached from a portion of a vehicle (not numbered) for example. The bearing 80 includes balls or rollers (not numbered) located between an external ring (not numbered) and an internal ring 81. The detaching elements 21 are configured for detaching bearings, i.e., each of the detaching elements 21 is formed with a jaw 213, an internal holding portion 214 and an external holding portion 215. The jaws 213 of the detaching elements 21 are inserted in the bearing 80. Then, the knob 56 is operated to rotate the conveying screw 50 and translate the detaching elements 21 from each other along the conveying screw 50 to engage the external holding portions 215 of the detaching elements 21 with the internal ring 81 of the bearing 80. The handle bar of the rear end element 12, which is connected to the operative rod 10, is operable to detach the bearing 80 from the vehicle.

Alternately, the sliding hammer 82 is moved toward the rear end element 12 from the front end element 11 along the operative rod 10. Thus, the sliding hammer 82 finally hits the anvil 822 of the rear end element 12, which is connected to the operative rod 10. Hence, the operative rod 10 is jerked, and so is the bearing 80. The bearing 80 can be detached from the portion of the vehicle by executing the above-mentioned process for several times.

Figure 9:
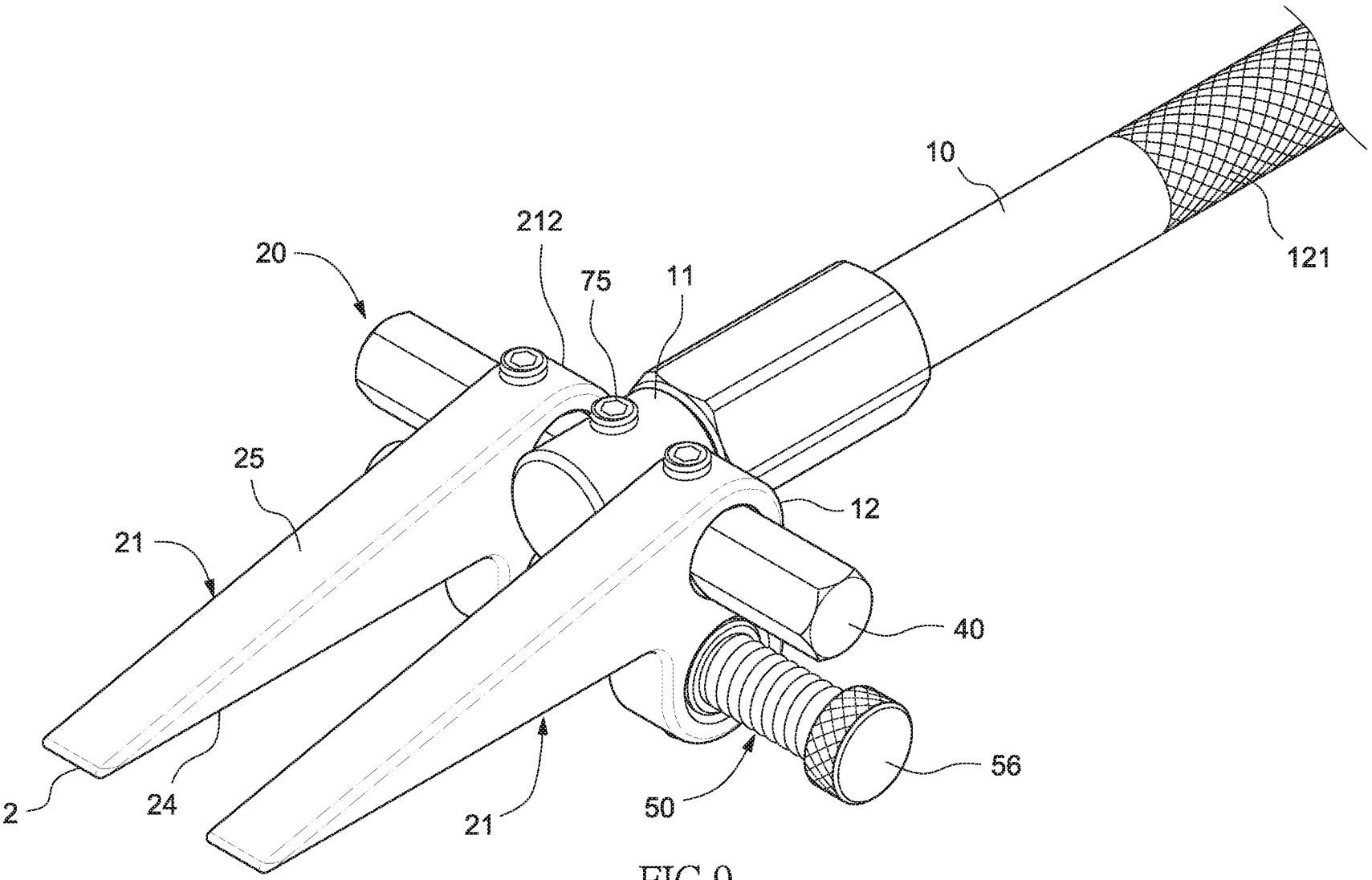
FIG. 9 is a partial perspective view of a tool according to the second embodiment of the present invention.

Referring to FIG. 9, a tool is configured to detach a ball joint from a suspension system of a vehicle (not shown) according to a second embodiment of the present invention. The second embodiment is like the first embodiment except for several features.

Firstly, each of the detaching elements 21 is shaped like a wedge including two faces 24 and 25 between the front and rear ends 211 and 212 the detaching elements 21. The first face 24 extends substantially horizontally and the second face 25 extends downward to the front end 211 from the rear end 212 when an axis of the operative rod 10 extends horizontally.

In use, the detaching elements 21 are inserted in a gap between the ball joint and a linking rod. Then, the operative rod 10 is pushed toward the ball joint so that the detaching elements 21 are moved relative to the ball joint. Thus, the second faces 25 of the detaching elements 21 detach the ball joint from the linking rod.

Secondly, the operative rod 10 is formed with an anti-skid section 121 near rear end element 12 to facilitate the operation of the operative rod 10.

Thirdly, it does not include the sliding hammer 82.

Fourthly, it does not include the rear end element 12.

Figure 10:
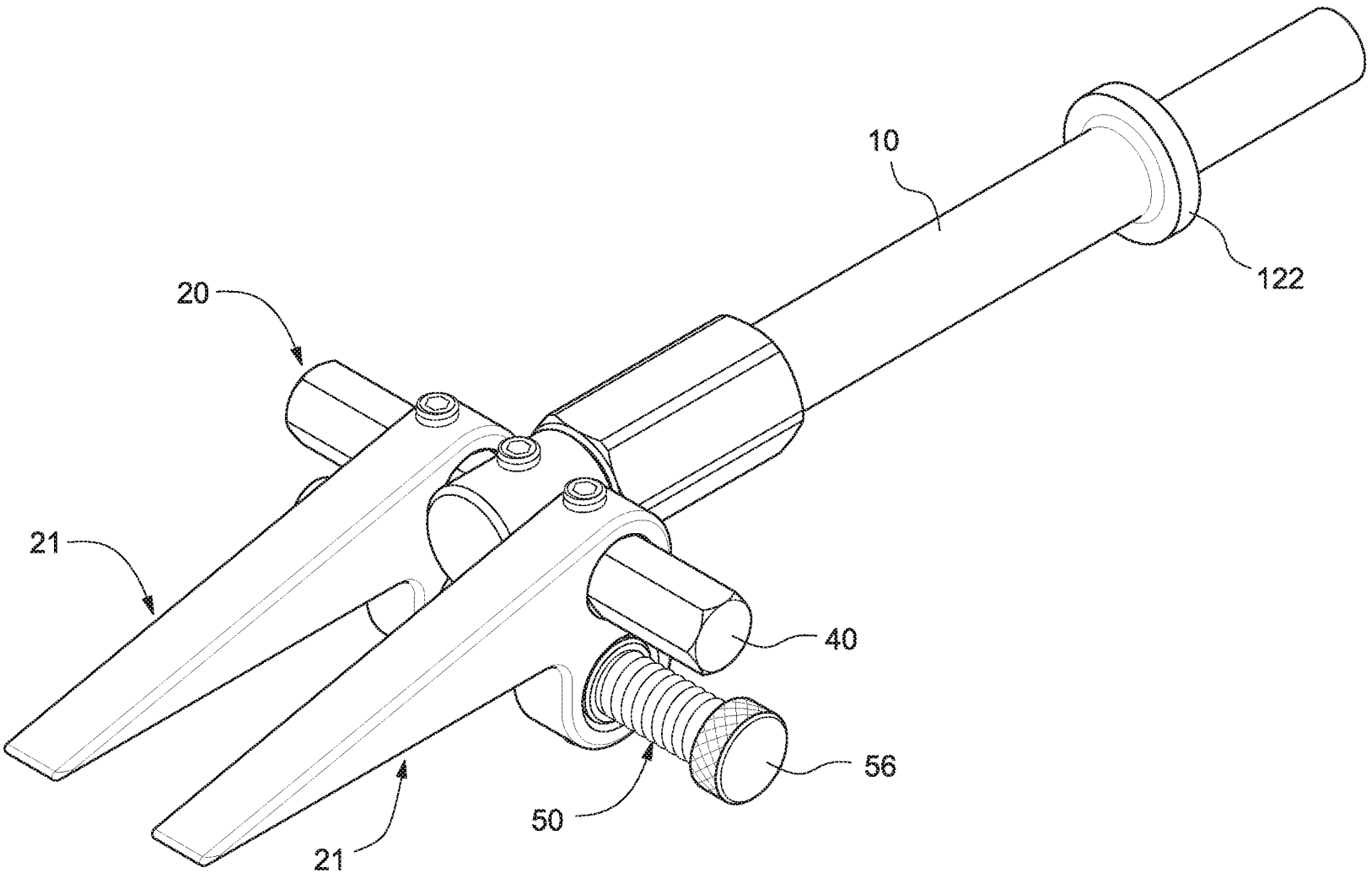
FIG. 10 is a perspective view of a tool according to the third embodiment of the present invention.
Figure 11:
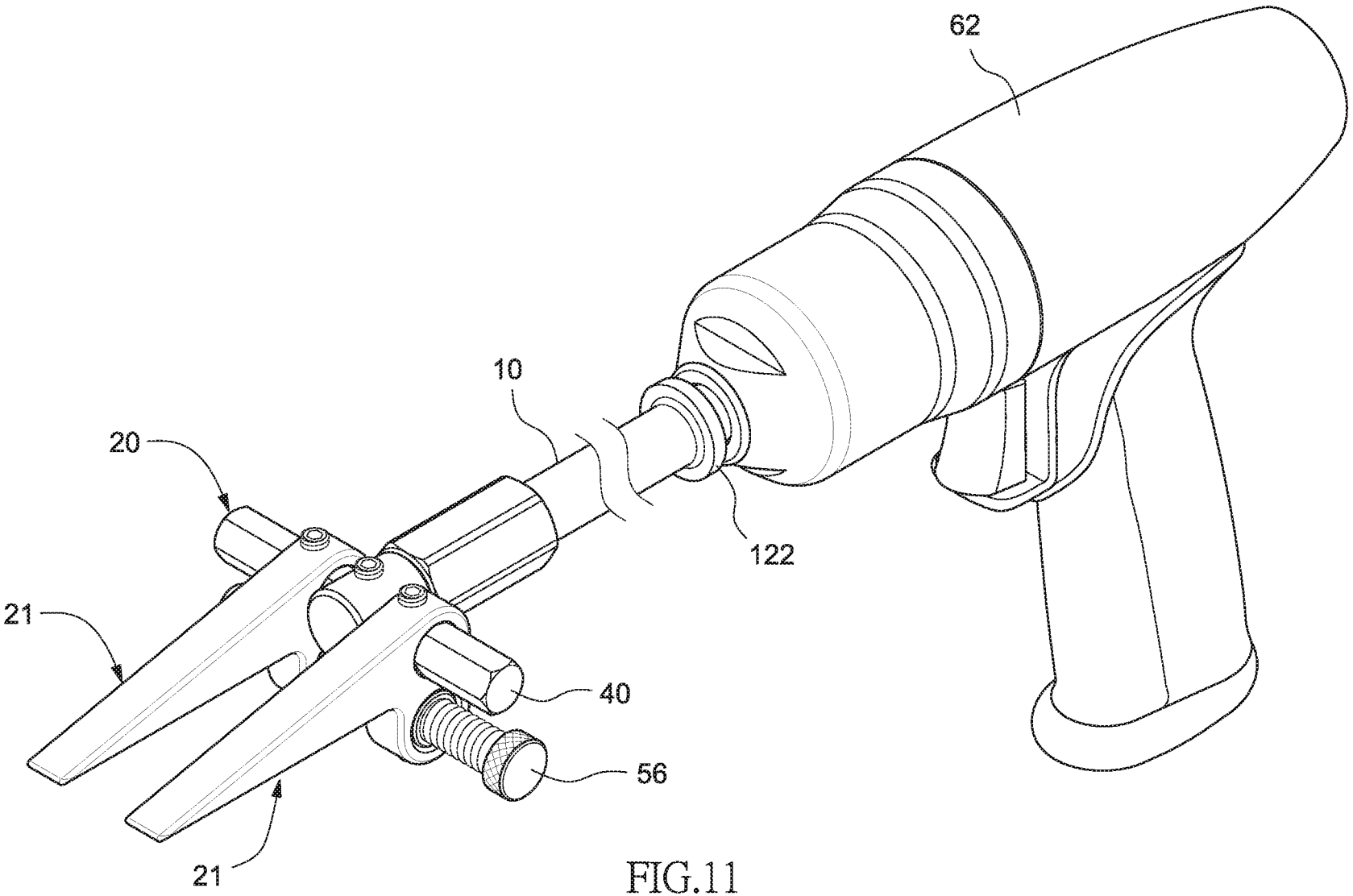
FIG. 11 is a power tool used with the tool shown in FIG. 10.

Referring to FIGS. 10 and 11, there is a tool according to a third embodiment of the present invention. The third embodiment is like the second embodiment except that the operative rod 10 is formed with an annular flange 122 instead of the anti-skid section 121.

In use, the rear end of the operative rod 10 is inserted in a power tool 62 such as a pneumatic hammer. The power tool 62 is actuated to hit the operative rod 10 by the annular flange 122.

The present invention has been described via illustration of the embodiments. Those skilled in the art can derive variations from the embodiments without departing from the scope of the present invention. Therefore, the embodiments shall not limit the scope of the present invention defined in the claims.

The invention claimed is:

1. A tool for detaching parts of various sizes from vehicles, the tool comprising:

an operative rod;

a guiding rod comprising a middle section connected to the operative rod and two terminal sections extending from the middle section;

a conveying screw comprising two threaded sections and two annular flanges formed between the threaded sections, wherein threads of the threaded sections extend in opposite directions;

two detaching elements each of which comprises:

a fixing aperture receiving a corresponding one of the terminal sections of the guiding rod; and a screw hole for receiving a corresponding one of the threaded sections of the conveying screw so that the detaching elements are moved toward each other when the conveying screw is rotated in a first direction and that the detaching elements are moved from each other when the conveying screw is rotated in a second direction; and a positioning element comprising:

a section inserted in the operative rod; and a tip confined between the annular flanges.

2. The tool according to claim 1, wherein the positioning element is a threaded rod, and the operative rod comprises a screw hole for receiving the threaded rod.

3. The tool according to claim 1, wherein the guiding rod is a polygonal rod, and the fixing aperture is a polygonal aperture for receiving the polygonal rod.

4. The tool according to claim 1, wherein each of the detaching elements comprises a screw hole in communication with the fixing aperture and used to receive a screw for abutting against the guiding rod.

5. The tool according to claim 1, further comprising a knob connected to the conveying screw so that the knob is operable to rotate the conveying screw.

6. The tool according to claim 1, wherein each of the detaching elements comprises a jaw and an internal holding portion on an internal side of the jaw.

7. The tool according to claim 6, wherein each of the detaching elements comprises an external holding portion formed on an external side of the jaw.

8. The tool according to claim 1, wherein each of the detaching elements comprises:

a first face extending horizontally when the operative rod extends horizontally; and a second face extending downward toward a tip.

9. The tool according to claim 1, wherein the conveying screw comprises a smooth section formed between the annular flanges, and the tip of the positioning element is in contact with the smooth section of the conveying screw.

10. A tool for detaching parts from vehicles comprising:

an operative rod;

a guiding rod comprising a middle section connected to the operative rod and two terminal sections extending from the middle section;

a conveying screw comprising two threaded sections and two annular flanges formed between the threaded sections, wherein threads of the threaded sections extend in opposite directions;

a detaching module comprising:

two adjusting rings each of which comprises a screw hole for receiving a corresponding one of the threaded sections of the conveying screw; and two detaching elements each of which comprises a detaching elements comprising:

a fixing aperture receiving a corresponding one of the terminal sections of the guiding rod; and an adjusting aperture for receiving a corresponding one of the adjusting rings non-rotationally so that the detaching elements are moved toward each other when the conveying screw is rotated in a first direction and that the detaching elements are moved from each other when the conveying screw is rotated in a second direction;

a positioning element comprising:

a section inserted in the operative rod; and a tip confined between the annular flanges.

* * * * *